United States Patent [19]

Boxall

[11] Patent Number: 4,505,131

[45] Date of Patent: Mar. 19, 1985

[54] INSULATED CABINET

[76] Inventor: Stanley S. Boxall, P.O. Box 80383, Chamblee, Ga. 30366

[21] Appl. No.: 474,353

[22] Filed: Mar. 11, 1983

[51] Int. Cl.[3] ..... F25D 17/04; F25D 19/02

[52] U.S. Cl. ..... 62/407; 62/417; 62/448; 62/457

[58] Field of Search ..... 62/237, 441, 448, 449, 62/457, 406, 407, 408, 417, 418, 387, 371, 372, 96, 186, 327, 419, 420, 421, 422, 423

[56] References Cited

U.S. PATENT DOCUMENTS

| | | | |
|---|---|---|---|
| 1,717,683 | 6/1929 | Hanrahan | 62/418 |
| 1,883,939 | 10/1932 | Killeffer et al. | 62/408 X |
| 2,462,279 | 2/1949 | Passman | 62/186 X |
| 2,466,876 | 4/1949 | Brouse | 62/282 |
| 2,812,642 | 11/1957 | Jacobs | 62/441 X |

*Primary Examiner*—Harry Tanner

*Attorney, Agent, or Firm*—Jones & Askew

[57] ABSTRACT

An insulated cabinet for keeping and displaying perishable articles at reduced temperatures. The refrigerated cabinet provides recirculation of chilled air about a closed path by convection, and provides a simplified technique for adjusting the temperature within the cabinet. Also disclosed is a freezing-cabinet modification. The cabinet may have separate goods-receiving spaces maintained at different temperatures. Relatively inexpensive manufacturing and operating costs are a criterion of the cabinet.

5 Claims, 11 Drawing Figures

INSULATED CABINET

FIELD OF INVENTION

This invention relates in general to insulated cabinets, and relates in particular to refrigerated cabinets for containing and displaying foodstuffs or the like.

BACKGROUND OF THE INVENTION

Refrigerated display cabinets are commonplace in point-of-sale merchandising for many products. Perishable foodstuffs such as meat and dairy products must be refrigerated to avoid spoilage or thawing, and various other food products such as candy and packaged beverages frequently are refrigerated by the retailer to maintain freshness or to chill the products for immediate consumption by the purchaser. In either application, the refrigerated display case for many retail applications has evolved into an attractive self-service merchandising fixture, in addition to its functional purpose of keeping foodstuffs chilled or frozen.

Refrigerated display cabinets of the prior art generally are large and correspondingly expensive. Such refrigerated display cabinets typically are intended for permanent installation as part of the merchandising display in a store, and usually require compressors or other refrigerating equipment external to the refrigerated cabinet itself. Even free-standing refrigerator or freezer cabinets tend to be relatively large, immobile, and costly to acquire and operate, inasmuch as these cabinets generally are intended for fixed installation in relatively large-scale merchandising operations such as supermarkets or the like. Such prior-art refrigerated cabinets, while appropriate for their intended applications, simply are too expensive for many smaller or low-volume sales outlets. Merchants in areas of sparse population or limited-income consumers are concerned with reducing their operating costs, and frequently cannot justify either the acquisition expense or the ongoing operating costs of the contemporary refrigerated cabinet. Moreover, such refrigerated cabinets seldom are light and small enough to be carried and moved by one person of average strength, and thus are not truly portable.

SUMMARY OF THE INVENTION

Stated in general terms, the present invention is a refrigerated cabinet which is relatively inexpensive to produce and operate. The present cabinet operates with a self-enclosed refrigeration unit including a compressor which may be of conventional design, and preferably utilizes convection to establish a recirculating flow of cold air within the cabinet. The cabinet itself preferably is designed to be plastic molded from one mold, or to be fabricated from flat or shallow foamed plastic sections, and may be shipped as a knocked-down compact package for assembly remote from the point of manufacture.

Stated somewhat more specifically, the present refrigerated cabinet includes an insulated enclosure defining a space for receiving goods, and refrigerating apparatus within the cabinet for refrigerating or freezing the goods within this space. The refrigerating apparatus includes a cooling coil located in a closed air flow path for convective air recirculation within the enclosure. The cooling coil may be located outside the goods-receiving space, at an upper end of a vertical region comprising the air recirculating path, so that relatively dense cooled air falls down from the cooling coil. This cooled air flows downwardly through a region of diminishing aperture or cross-section area, tending to increase the velocity of the cooled air moving through the closed path. The air recirculation path travels below the goods-receiving space, and the convective flow of air is aided by a downwardly-sloped air passage beneath the goods-receiving space. Access to that space is through a closable opening above the space, so that the stratified cold air does not spill when the access door is opened. The air recirculation path also provides a flow of air over the closable access opening to the space so as to provide a curtain of flowing cooled air separating the goods-receiving space from the warmer ambient atmosphere. Temperature adjustment may be provided by various expedients, and the goods-receiving space may be divided into areas maintained at different temperatures for keeping different kinds of goods.

The present cabinet alternatively can be configured as a freezer cabinet to store goods at sub-freezing temperatures.

Accordingly, it is an object of the present invention to provide an improved refrigerated cabinet.

Still another object of the present invention is to provide a lightweight and highly portable refrigerated display cabinet.

It is another object of the present invention to provide a refrigerated cabinet that is relatively inexpensive to produce and operate.

It is yet another object of the present invention to provide a refrigerated cabinet of relatively simple and economic construction, yet which maintains a recirculating flow of cooled dehumidified air within the goods receiving space.

It is a further object of the present invention to provide a refrigerated cabinet including a temperature adjusting mechanism of simple construction.

Other objects and advantages of the present invention will becomes more readily apparent from the following description of the preferred embodiments.

DESCRIPTION OF THE PREFERRED EMBODIMENTS

Figure 1:
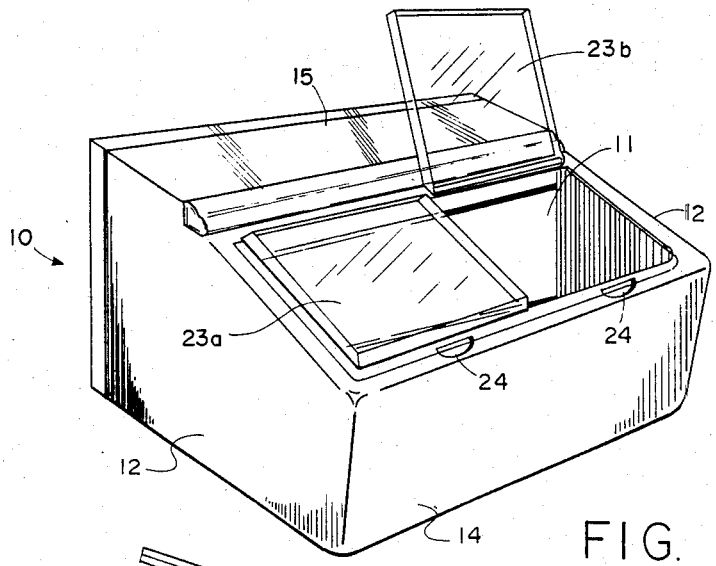
FIG. 1 is a pictorial view showing a refrigerated cabinet according to a disclosed first embodiment of the present invention.
Figure 2:
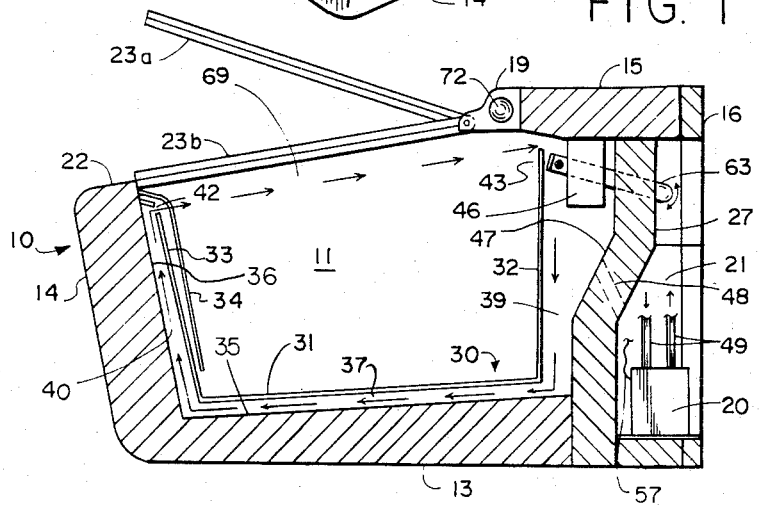
FIG. 2 is a vertical section view of the cabinet shown in FIG. 1.

Turning first to FIG. 1, there is shown generally at 10 an insulated cabinet defining an open interior region 11 for receiving goods. The cabinet 10 includes the sides 12, a bottom section 13, and a front wall 14 extending upwardly from the bottom at a slight forward angle as best seen in FIG. 2. The cabinet 10 further includes a generally horizontal top panel 15 extending forwardly from the back 16 of the cabinet. The top panel 15 extends forwardly approximately one-third the overall depth of the cabinet 10, terminating at the molding strip 19 extending across the width of the cabinet. As best seen in FIG. 2, the cabinet back 16 preferably is a separate member removably attached to the remainder of the cabinet, thereby permitting access to the compressor 20 and related components of the refrigeration system, located within the hollow region 21 normally concealed behind the back of the cabinet. The refrigeration system preferably is self-contained and removable in toto from the cabinet as explained below.

The front wall 14 of the cabinet terminates at an upper edge 22 which is lower than the elevation of the top panel 15 and molding strips 19, as best seen in FIG. 2. The region between the molding strip 19 and the upper edge 22 of the front wall defines the access opening into the interior region 11 of the cabinet, and this access opening normally is closed by a pair of doors **23*a*, 23*b* hinged parallel to the molding strip. Each door may be opened by pivoting upwardly and back about the respective hinge, and the hinges may accommodate an over-center position allowing the door to rest in the open position as illustrated by the door 23*b* in FIG. 1. A pair of finger niches 24 are formed in the front wall 14 to assist in opening or closing the doors. It will of course be understood that a single door extending the entire width of the opening into the interior region 11 may be substituted for the two half-width doors 23*a* and 23*b*. The doors may be made of a suitable transparent plastic material allowing the shopper to use the interior region 11 and the goods contained therein, and the doors may be of double-wall construction having an enclosed air space so as to insulate the opening into the interior region. The interior 11 of the cabinet can be illuminated by a suitable lamp 72 if desired, preferably located within the molding strip 19** behind the hinge connection for the doors.

Turning to FIG. 2, the cabinet 10 is seen to include a vertical internal wall 27 extending from the cabinet bottom to join the top panel 15. This internal wall 27, together with the bottom 13, front wall 14, sides 12, and the top panel, provide the insulated closure within which the interior goods-receiving space 11 is defined. It can be seen that each wall or panel of the insulated cabinet is substantially flat or relatively shallow in angle, and these panels can be inexpensively formed of insulating material such as foamed plastic or the like. Although the bottom 13 and front wall 14 comprises a single integral member in the disclosed embodiment, it should be understood that these members can be made of two substantially flat panels which are the joined together (along with the sides and other panel members) to provide the overall cabinet 10. Thus, the structural panels making up the present insulated cabinet, together with the internal wall 27 and the back 16, can be fabricated and shipped in knocked-down form for assembly at a location remote from the point of fabrication. The knocked-down components for assembling cabinets thus can be stored and transported in far more compact space than the assembled cabinet, thus effecting a further saving.

The goods-receiving region 11 within the cabinet is further defined by a pan 30 having a substantially plane bottom surface 31, a vertical back face 32, and a front face 33 extending forwardly at an angle substantially paralleling the forward angle of the front wall 14. The product pan 30 preferably is readily removable from the cabinet 10 for cleaning, and may be fabricated from a single sheet of easily cleanable material. Preferably, the product pan 31 is made of metal for good heat-conductive qualities, and for easy cleaning. A wire grill 34 may extend downwardly over the front 33 of the product pan, to keep goods spaced slightly back from the front wall and thus facilitating placement and removal of goods within the space 11. Alternatively, the product pan 31 itself may take the form of a wire grill spaced above the bottom surface 35 and the front surface 36 of the cabinet; goods stacked on the wire grill will block the grill openings, and thus effectively define a passage beyond the goods for convective airflow.

The bottom 31 of the product pan 30 is spaced above the bottom surfaces 35 of the cabinet bottom 13, thereby defining an open region 37 between the cabinet bottom and the product pan. The product pan 30 can be supported above the cabinet bottom 13 by spacing members (not shown) molded or otherwise formed on the cabinet bottom, or alternatively by supports on the product pan itself. Moreover, the back face 32 and front face 33 of the product pan also are spaced apart from the respective confronting insulating walls 27 and 14, so as to define the vertically-extending open back region 39 and front open region 40, immediately outside the back and front walls of the product pan. These open regions 39 and 40 join the bottom open region 37 beneath the bottom surface 31 of the product pan. The back of the bottom surface 35 is higher than the front, providing a downward pitch of the open region 37 from the back of the space 11 to the front as best seen in FIG. 2. The product pan 31 (or grill) likewise is pitched toward the front of the space 11, so that the downward pitch aids convective air flow as described below.

The front wall 33 of the product pan stops short of the cabinet upper edge, thereby defining an elongated air inlet 42 to the space 11 extending across the front of the space immediately below the cabinet upper edge. The back face 32 of the product pan likewise terminates below the confronting top panel 15 of the cabinet, thereby providing an elongated air outlet 43 communicating with the upper end of the open region 39 located behind the back face of the product pan. It can now be seen that the air inlet 42 and air outlet 43, together with the open regions 37, 39, and 40 on three sides of the product pan 30, define a closed path for air to recirculate around and including the goods-receiving space 11 within the insulated cabinet 10.

The open region 39 behind the back face 32 has an upper part within which the cooling coil 46 is mounted. Below the cooling coil 46, the open region 39 diminishes in aperture or cross-section area, due to the forwardly-sloped portion 47 of the internal wall 27 behind the back face 32 of the product pan. A condensate drain opening shown in phantom at 48, FIG. 2, extends outwardly from a condensate collector located below the cooling coil 46, but omitted from the drawing for illustrative purposes. It will be understood that condensation collected from the cooling coil 46 in the normal course of operation flows through the drain 48 and preferably is routed in a suitable manner to the conventional warm condensing coil (not shown) associated with the refrigeration system, so that the condensate is there evaporated. In this manner, no liquid drain from the cabinet need be provided. The cooling coil 46 is connected by the refrigerant lines 49 to the refrigeration compressor 20, located in the region 21 behind the internal wall 27 of the cabinet.

Figure 3:
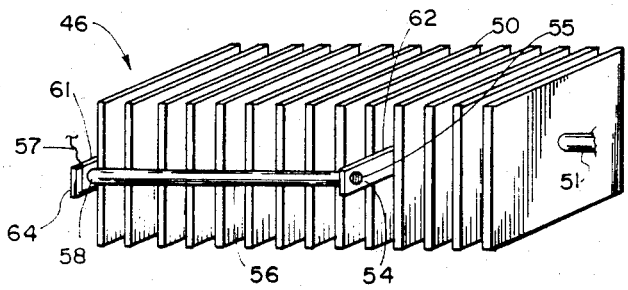
FIG. 3 is a detailed pictorial view of the cooling coil and temperature adjusting mechanism used in the cabinet of FIG. 1.

Additional details of the cooling coil 46 are shown in FIG 3. The cooling coil includes a number of heat radiating fins 50 radiating from at least one refrigerant line 51 connected in circuit to the lines 49 from the compressor 20. It will be understood that the chilled refrigerant line 51 cools the fins 50, which in turn remove heat from the air surrounding the fins.

The operation of the compressor 20 is controlled by a thermostat sensor 54, protruding outwardly from one end 55 of a supporting tube 56 disposed in front of the finned cooling coil 46. The thermostat sensor 54 may be of conventional constructipn and operation, and is connected by control line 57 to the compressor 20. As seen in FIG. 3, the sensor control line 57 extends from the other end 58 of the thermostat sensor supporting tube 56.

The thermostatic sensor supporting tube 56 is supported for selective movement relative to the fins 50 of the cooling coil 46. This movable support is provided by a control lever 61, best seen in FIG. 4, and by a support arm 62, best seen in FIG. 5. The control lever 61 is supported for pivotable movement about the refrigerant line 51 at one end of the cooling coil 46, and has a control handle 63 extending a distance behind the finned cooling coil. The forward end 64 of the control handle 63 supports the end 58 of the sensor supporting tube 56. The support arm 62 has an inner end 66 likewise pivotably located on the refrigerant line 51 of the cooling coil, and has an outer end 67 holding the end 55 of the sensor supporting tube 56. The control handle 63 of the control lever 61 extends behind the cooling coil 46 and through an aperture formed in the internal wall 27 of the cabinet 10, as best shown in FIG. 2, to be present in the hollow region 21 behind the internal wall.

The operation of the embodiment described above will now be considered. As the cooling coil 46 receives chilled refrigerant from the compressor 20, the air in the vicinity of the cooling coil becomes relatively dense and thus tends to fall within the open region 39 behind the back face 32 of the product pan 30. The volume of downwardly-moving cooled air enters the region of reduced aperture formed by the sloped portion 47 of the internal wall, causing the velocity of the moving air to increase. The cooled air thus moves downwardly through the open region 39 and forwardly through the open region 37 beneath the bottom surface 31 of the product pan, aided by the downward pitch of the bottom open region 37, and upwardly along the open region 40 in front of the product pan. This flow of cooled air enters the interior region 11 through the air inlet 42 at the front of that region, and flows in the indicated path leading to the air outlet 43 at the top of the back face 32. The air received through the air outlet 43 thus is again subjected to the cooling coil 46, where heat transferred to the air in its closed path is removed. The recooled air again falls through the decreasing-aperture region behind the back face 32, again accelerating the rate of convective flow, and so the convective air flow process is maintained.

It can thus be seen that the interior region 11 and products therein are cooled by the flow of air through the closed path surrounding this region, and also are cooled by conduction through the cooled surfaces of the product pan or grill 30. Thus, products resting at or near the surfaces of the product pan are cooled by contact with those cooled surfaces, even though those products may not be directly exposed to the convective flow of air through the interior region. It will also be understood that the air flow 69 along the top of the interior region provides an air-curtain effect which re-entrains precooled air within the interior space and tends to minimize the inflow of warmer outside air whenever the doors 23*a*, 23*b* are open. Because the access opening is at the top of the interior region 11, little or no cool air spills from the cabinet when the doors are open, thereby enhancing the efficiency of the refrigerated cabinet.

Figure 4:
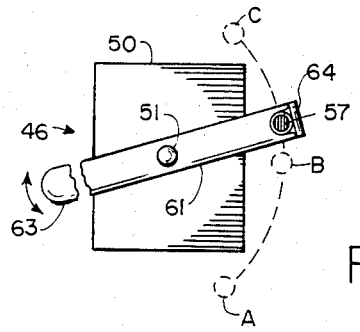
FIG. 4 is an end view of the cooling coil, as seen from the left side of FIG. 3.
Figure 5:
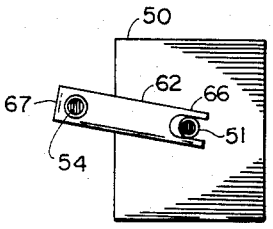
FIG. 5 is a vertical section view taken through the cooling coil of FIG. 3, showing the pivotable support for the thermostat sensor.

The cooling effect of the cooling coil 46 on the thermostat sensor 54, and thus the operation of the compressor 20, is determined by the sensor position relative to the cooling coil. This position, in turn, is adjusted by moving the control handle 63, thereby moving the control lever 61, support arm 62, sensor supporting tube 56, and the thermostat sensor 54 in an arc which varies the spacing and location of the sensor relative to the cooling coil as illustrated in FIG. 4. Thus, with the sensor at location A closely below the cooling coil 46, the thermostat sensor is maintained at its coldest point and the compressor 20, controlled by the sensor, operatese less frequently. Moving the control handle 63 downwardly raises the sensor to location B outwardly and in front of the coil. The thermostat sensor is least cold at location B, causing the compressor 20 to operate more frequently and produce greater cooling effect within the interior region 11. At position C above the cooling coil, a medium cooling point is reached. The mechanical sensor positioning arrangement provides a very inexpensive variable setting for temperature control, requiring no electrical controls, bimetallic sensors, or other relatively sophisticated control devices which might increase manufacturing costs and/or be beyond the assembly skils of relatively unsophisticated labor.

The embodiment as thus far described is intended to maintain goods at a reduced temperature to prevent spoilage, but not necessarily to maintain frozen foods. However, with the modification shown in FIG. 6, the cabinet is readily converted to a freezer cabinet 10' suitable for storing frozen foodstuffs or the like. This modification is easily accomplished by inserting a cold plate 71 in the open region 31 below the product pan 30. The cold plate 71 may be of conventional construction, including a relatively thin metallic plate containing a line connected to receive refrigerant from the compressor 20 by way of the line 71 extending through an opening in the internal wall 27 of the cabinet. The cold plate 71 receives the entire output from the compressor 20, and so the cold plate 71 may be in direct thermal conductive contact with the product pan 30, although the two members are shown spaced apart in FIG. 6 for illustrative purposes. The cold plate is designed to operate at a sufficiently low temperature to maintain the product pan 30 at a subfreezing temperature adequate to maintain frozen foodstuffs within the interior region 11 of the cabinet 10'.

Figure 6:
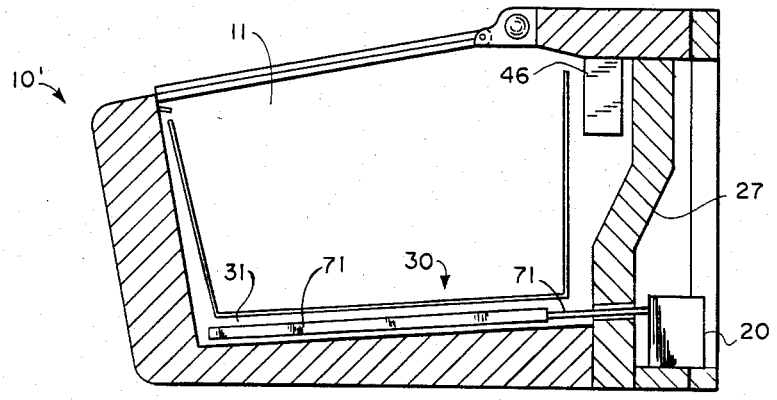
FIG. 6 is a vertical section view showing an alternative embodiment of the present invention, configured for freezer operation.

It will be understood that no convective airflow takes place in the freezing cabinet 10', inasmuch as the cooling coil 46 is nonfunctional in that cabinet. Indeed, the cooling coil 46 and related structure defining the closed air circulation path can be omitted from the embodiment of FIG. 6, but those structural features are retained to illustrate that a basic insulated cabinet according to the present invention is easily and inexpensively adapted to provide either a refrigerated cabinet as shown at 10 in FIGS. 1–5, or to provide a freezing cabinet 10' as shown in FIG. 6. The primary difference between refrigerating and freezing cabinets lies in the addition of the cold plate 71 in the space already provided beneath the product pan 30, together with suitable connection to the compressor 20.

FIGS. 7–11 show alternative embodiments of the present refrigerated cabinet in which the insulated cabinet 78 may be of one-piece molded construction and the self-contained refrigeration unit 79 is unitary and easily fits within the rear of the cabinet. The goods-receiving space and cold-air inlet features of the separate embodiments shown in FIGS. 9 and 10 differ from the FIG. 8 embodiment, but the basic design of cabinet and self-contained refrigeration unit is common to the embodiments shown in FIGS. 8–10. The back panel 80 is removably attached to the back of the cabinet 78, and encloses the cabinet with the refrigeration unit 79 in place, FIG. 11.

Figure 7:
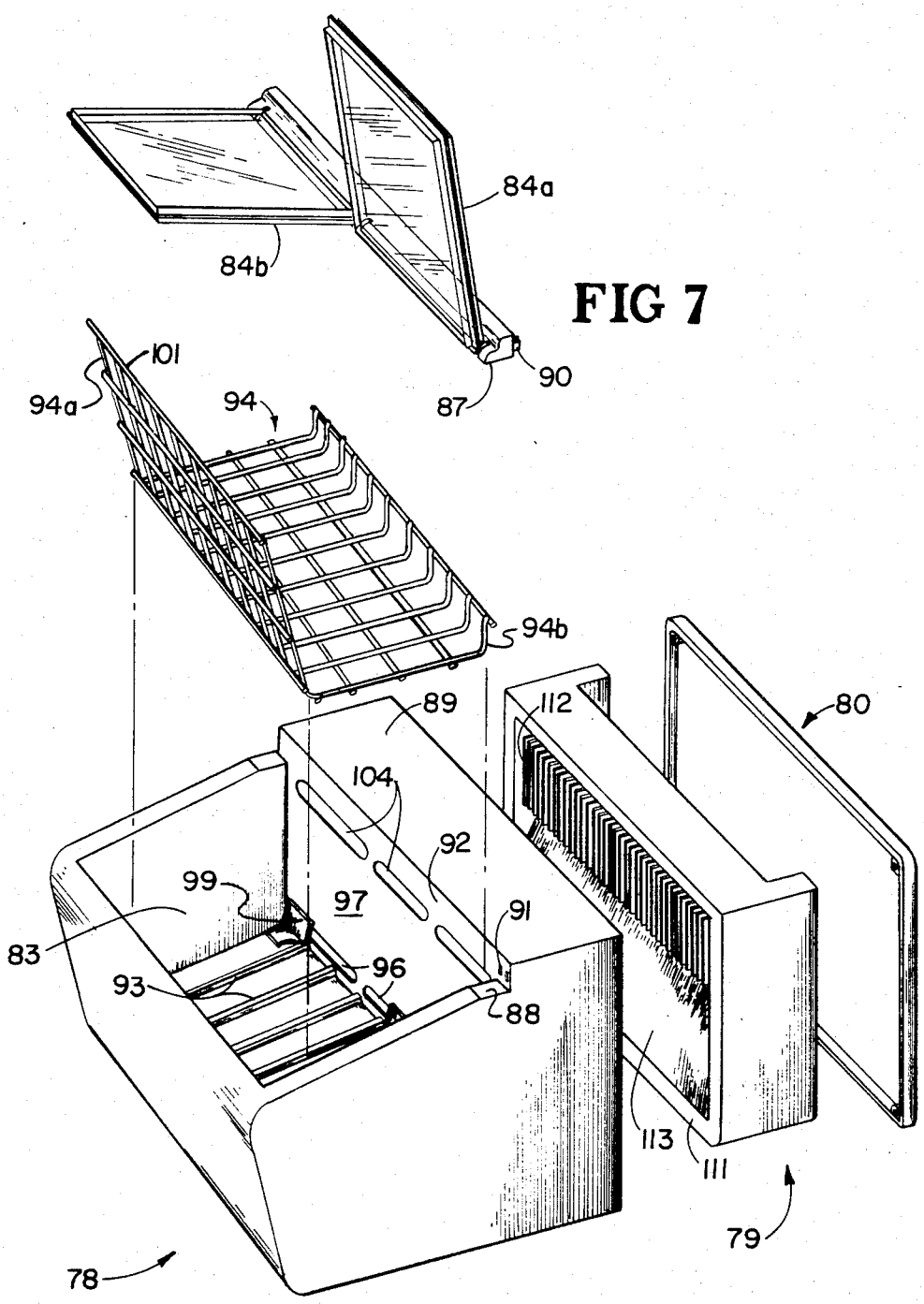
FIG. 7 is an exploded pictorial view showing another alternative embodiment of the present invention.
Figure 9:
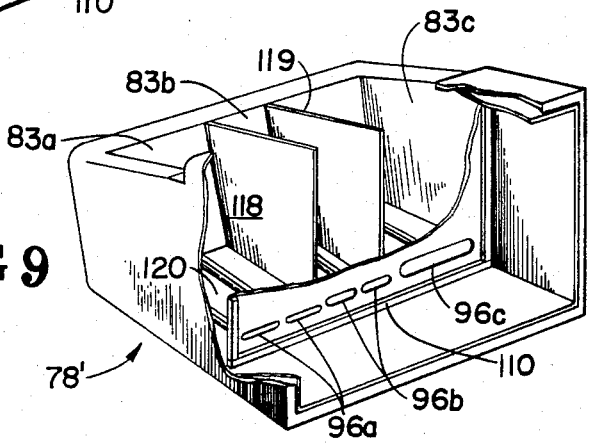
FIGS. 9 and 10 are broken-away rear pictorial views showing the cabinets of two modified versions of the embodiment shown in FIG. 7, with the goods-receiving spaces divided into several compartments maintainable at different temperatures.

The cabinet 78, as best seen in FIG. 9, preferably is of unitary construction and may be molded or otherwise formed of a suitable insulating material such as urethane foam or the like, having a relatively tough outer skin 81 to form the outside surface of the cabinet. The inner skin 82 forms the surfaces defining the interior goods-receiving space 83, having an open top which is selectably closable by the doors **84*a*, 84*b* (FIG. 7). These doors are hinged to the molding strip 87 which removably fits within the recess 88 at the front of the top surface 89 of the cabinet. The molding strip 87 may contain a lamp similar to the lamp 72 shown in FIG. 2, and operating power for the lamp is supplied through the plug-in connection 90 engaging the socket 91 flush-mounted along the edge 92 between the recess 88 and the top surface 91. This plug-socket arrangement permits the door assembly, made up of the molding strip 87 and doors 84*a*, 84*b*, to be readily removed from the cabinet 78** as desired. The door assembly may be secured in place by suitable fasteners, not shown.

Figure 11:
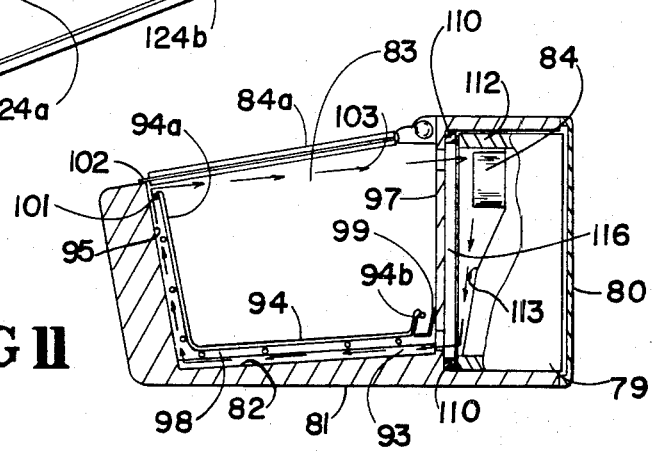
FIG. 11 is a vertical section view of the embodiment shown in FIG. 7, with the refrigeration unit in place and unsectioned.

Within the interior region 83 of the cabinet 78 is the wire rack 94, spaced apart from the bottom of the interior region as shown in FIG. 11. The wire rack includes an upturned forward portion **94*a* which extends upwardly and in spaced apart relation from the forward wall 95 of the interior region, and also includes a shorter upturned back portion 94*b* which extends above the elongated air outlet slots 96 formed adjacent the bottom of the rear wall 97 defining the interior region 83. The wire rack 94 rests on a number of parallel ridges 93 raised above the bottom of the space 83 and preferably molded with the inner skin 82. The rack 94 thus is raised above the bottom, and the open region 98 between the wire rack and the bottom of the space 83 comprises the path for convective air flow as described below. An elongated strip 99 (shown partially broken away in FIG. 7) may be positioned behind the back portion 94*b* of the grill 97, in spaced apart confronting relation to the air inlet slots 96 in the rear wall, to guide the incoming cold air downwardly to flow along the open region 98**.

It should be understood that the cabinet 78, in use, normally contains packaged products such as beverages or the like resting on the bottom of the wire rack 94, and these products tend to block the open spaces of the wire rack and thus aid in defining the convective flow path through the open region 88. The goods should be loaded into the space 83 from the back forward, so as to help establish the proper direction of incoming cold air along the forwardly sloping open region 98. The upper edge 101 of the wire rack forward portion **94*a* is located below the lip 102 along the front of the opening normally closed by the doors 84*a*, 84*b*, so that the gap between the wire rack upper edge and the lip forms an air flow inlet directing the convective flow of air as indicated by the arrows 103. This convective flow of air extends from front to back along the top of the interior region 83, extending to the air outlet slots 104 at the upper edge of the rear wall 97**.

Figure 8:
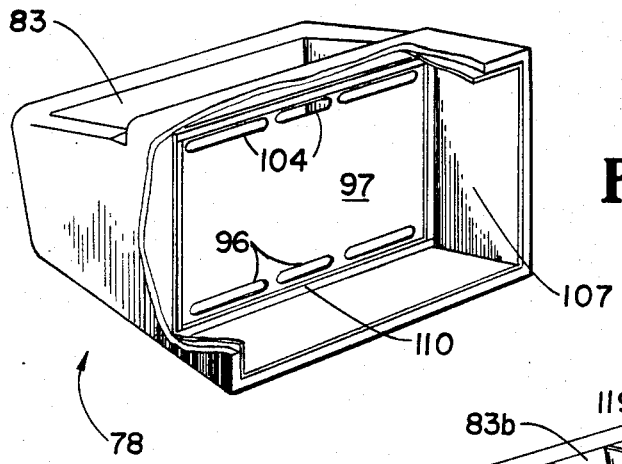
FIG. 8 is a rear pictorial view showing the cabinet of the embodiment in FIG. 7, with the refrigeration unit removed and the cabinet partially broken away for illustrative purposes.

Turning to FIG. 8, it is seen that the cabinet 78 defines an open cavity 107 at the back of the cabinet, behind the rear wall 97. The air outlet slots 104 and air inlet slots 96 extend through the rear wall 107 in communication with this cavity. The outlet slots 96 preferably are cut out of the rear wall 97 after molding, so that the outlet slots can be sized to allow a desired amount of cold air to pass into the goods-receiving space. Alternatively, the outlet slots can be cut or molded to a maximum size and the airflow can then be restricted by selectively obstructing part of the openings.

Within the cavity 107 of the cabinet 78, a rearwardly-facing gasket 110 is secured to the periphery of the rear wall 97. This gasket preferably is made of a readily-compressable material such as foam rubber or the like, and the air flow slots 96 and 104 are located within the perimeter of the gasket as best seen in FIG. 8.

The refrigeration unit 79, FIG. 7, is configured to be a snug sliding fit into the cavity 107 at the back of the cabinet 78. When the refrigeration unit 79 is in place within the cavity 107, the front surface 111 of the refrigeration unit snugly engaged the gasket 110 surrounding the rear wall 97, thereby enclosing the region between the rear wall and the front surface of the refrigeration unit.

The refrigeration unit 79 includes a conventional compressor (not shown) connected to the cold coils 112 mounted along the upper end at the front of the refrigeration unit. The refrigeration unit further includes a condensor unit and a suitable thermostatic control, which may be of conventional design and construction. It will be understood that the entire refrigeration unit 79 is enclosed within the cabinet 78 by the back panel 80, so that the refrigeration unit is easily removable for maintenance or replacement simply by removing the back panel and sliding the refrigeration unit from the cavity 107.

Turning again to FIG. 9, it is seen that an open region 116 is defined between the cabinet rear wall 97 and the front face 113 of the refrigeration unit 79 in place within the cabinet. The cross-section area of the open region 116 decreases from the top toward the bottom of that region, analogous to that of the open region 39 in the embodiment of FIG. 2; this declining-area configuration may be provided by the forwardly-sloping shape of the refrigeration unit front face 113 which partially defines the open region.

The cabinet 78, in operation, is substantially similar to the previously-described cabinet 10. Air at the top of the open region 116 becomes chilled by the cold coils 112 as the refrigeration unit 79 operates. This cooled air, being relatively dense, flows downwardly within the open region 116, and the decreasing area of the open region causes an increase in the velocity of the downwardly-moving air. This chilled air exits the open region 116 through the slots 96 near the lower end of the rear wall 97, and the chilled air then flows through the open region 98 beyond the wire rack 94, along the bottom and the forward wall 95 of the cabinet interior region 83. The chilled air next flows back across the upper end of the interior region, indicated by the arrow 103, and passes through the air outlet slots 104 to reenter the open region 116 to be chilled by the cold coils 112.

FIG. 9 shows a modification of the cabinet 78. In this modification, the goods-receiving space within the cabinet 78' is divided into three separate spaces 83*a*, 83*b*, 83*c* by the dividers 118 and 119 extending upwardly from the bottom surface 120 to terminate just below the access doors (not shown) which close the cabinet. Each space 83*a*, 83*b*, 83*c* receives cold air through separate groups of air inlet openings 96*a*, 96*b*, 96*c*, which preferably are sized to permit different volumes of cold air to enter the respective goods-receiving spaces. For example, the inlet opening 96*c* for the space 83*c* is larger than the air inlet openings for the other spaces so that goods in the space 83*c* are refrigerated at a colder temperature than in the two other spaces 83*a*, 83*b*. In this manner, the single cabinet 78' provides three different spaces for storing goods such as goods or medicines at different temperatures best suited to the goods.

Figure 10:
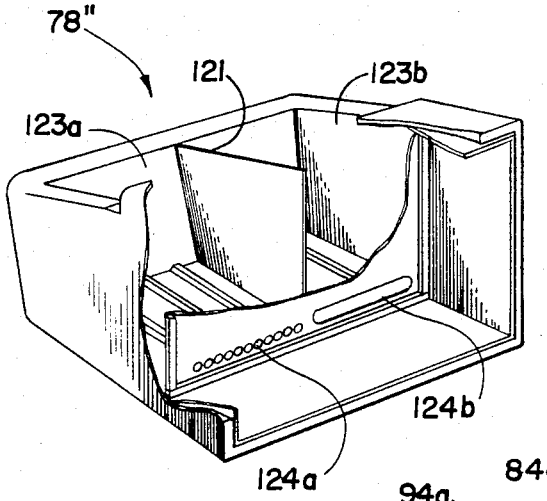

FIG. 10 shows another modified cabinet 78'', having a single divider 121 defining two separate spaces 123*a*, 123*b* within the cabinet. Cold air is supplied to the spaces 123*a*, 123*b* through the inlet openings 124*a*, 124*b*, which are sized to admit different amounts of cold air so as to maintain the spaces 123*a*, 123*b* at different temperatures.

The thermostat (not shown) of the refrigeration unit 79 may be preset at the time of manufacture, with the sensor secured to the cold coils in conventional manner, and normally is not adjusted to change or regulate the temperature within the cabinet 78. Thus, the embodiments shown in FIGS. 7–11 provide relatively inexpensive and compact refrigerated cabinets with a convection flow of air around the product receiving interior region(s), as previously described, with the added advantage of product temperature control by adjusting the volume of chilled air entering the cabinet. The embodiments shown in FIGS. 7–11 have the added advantage that the refrigeration unit 79 is easily removed as an integral unit for servicing or the like, and it should be understood that a defective refrigeration unit advantageously may be replaced in the field by an operating unit, and then returned to a shop for repair.

It will thus be seen that insulated cabinets for refrigerating or freezing have been disclosed which are relatively inexpensive to construct and operate. Continuous air flow circulation is maintained through the refrigerated cabinets without requiring the added acquisition cost and operating expense of recirculating fans or the like, although a fan can be provided if desired. The cabinet is also useful for recreational or other noncommercial purposes, for which insulated opaque doors may be substituted for the transparent doors.

It should also be understood that the foregoing relates only to disclosed embodiments of the present invention, and that numerous changes and modifications may be made therein without departing from the spirit and scope of the present invention as set forth in the following claims.

What is claimed is:

1. Refrigerated cabinet apparatus, comprising:

an enclosure defining an insulated region for receiving goods to be cooled;

means within said region defining a goods receiving support spaced apart from the bottom of said enclosure so as to define an air circulation passage therealong between said support and said enclosure;

means associated with said enclosure for defining a cavity separate from said insulated region;

first air flow means communicating between an upper location of said insulated region and an upper portion of said cavity;

second air flow means communicating between a lower portion of said cavity and said air circulation passage;

cooling means in the upper portion of said cavity to cool air therein, so that the cooled air moves downwardly along a path within said cavity and flows through said second air flow means to enter said air circulation passage in said goods receiving region; and means defining a vertical region of diminishing effective aperture on said path between said upper location and said lower portion of the cavity, so that the relatively dense air cooled by said cooling means moves downwardly through said vertical region of diminishing aperture and thereby moves at an increasing velocity before reaching said lower portion, so as to increase the velocity of cooled air moving by convection to said goods receiving region.

2. Apparatus as in claim 1, wherein:

said cavity is defined by a first wall separating the cavity from said goods receiving region, and by a second wall in spaced apart relation behind said first wall;

said cavity confronts said first wall and is configured to receive refrigerating means including said cooling means in spaced apart relation between said walls, so that an open region thus is defined between said first and second walls and receives said refrigerating means;

said first air flow means extends through an upper portion of said first wall to admit air from said goods receiving region into the upper end of said open region;

said second air flow means extends through a lower portion of said first wall to return cooled air to said air circulation passage from the lower end of said open region; and the separation between said first and second walls decreases along the downward extent of said cavity between said upper and lower portions of said first wall, thereby providing said vertical region of diminishing aperture through which the cooled air falls to increase velocity before reaching said lower portion.

3. Apparatus as in claim 2, wherein:

said refrigerating means is removably received in said cavity, and further comprising insulating means operative for sealing engagement with said refrigerating means when in place within said cavity, so as to provide an insulated seal between said open region between the refrigerating means and said wall.

4. Apparatus as in claim 2, wherein:

said refrigeration means comprises an air flow surface below said cooling means;

said air flow surface comprising said second wall and being spaced apart from said first wall to define said path along which cooled air moves downwardly toward said second air flow means; and said air flow surface and the confronting first wall having a mutually converging vertical region extending downwardly from said cooling means at least to a point above said lower portion of said first wall, so that the area of said path decreases as the cooled air moves downwardly through said converging region, thereby providing said diminishing effective aperture of the path.

5. Apparatus as in claim 1, further comprising:

divider means in said insulated region to divide the insulated region into a plurality of separate spaces for receiving goods;

said second air flow means is operative to admit unequal amounts of cool air to said separate spaces, so that the separate spaces are maintained at different temperatures; and said first air flow means communicates with all of said separate spaces, so as to maintain convective air circulation through said separate spaces and said cooling means.

* * * * *